United States Patent [19]

McIntyre

[11] Patent Number: 4,746,545

[45] Date of Patent: May 24, 1988

[54] FLUID COATING AND WEB-HANDLING METHOD AND APPARATUS PARTICULARLY ADAPTED FOR LOW-TENSION AND/OR UNEVENLY THICK WEBS

[75] Inventor: Frederic S. McIntyre, Wellesley, Mass.

[73] Assignee: Acumeter Laboratories, Inc., Marlborough, Mass.

[21] Appl. No.: 809,488

[22] Filed: Dec. 16, 1985

[51] Int. Cl.[4] ..... B05D 5/00; B05D 1/26; B05C 3/18; B05C 3/20

[52] U.S. Cl. ..... 427/176; 118/33; 118/410; 118/415; 427/286; 427/288; 427/358

[58] Field of Search ..... 427/176, 286, 288, 358; 118/33, 410, 415, 411; 68/200

[56] References Cited

U.S. PATENT DOCUMENTS

| | | | |
|---|---|---|---|
| 1,494,315 | 5/1924 | Ostenberg | 118/415 |
| 2,368,520 | 1/1945 | Burckhardt et al. | 118/415 X |
| 3,595,204 | 8/1971 | McIntyre | 118/8 |
| 4,277,301 | 7/1981 | McIntyre et al. | 118/411 X |
| 4,476,165 | 3/1984 | McIntyre | 427/258 |

*Primary Examiner*—Evan K. Lawrence

*Attorney, Agent, or Firm*—Rines and Rines, Shapiro and Shapiro

[57] ABSTRACT

A method of and apparatus for the hot melt or other fluid coating and the web handling of lightweight low web-tension-supporting, non-woven and similar materials, having a novel nozzle region using entrance and exit web-supporting surfaces and positioning in order to compensate for web deflection caused by the fluid coating ejection forces that otherwise render the coatings non-uniform and destroy sharp leading and trailing edges of intermittent coatings.

20 Claims, 2 Drawing Sheets

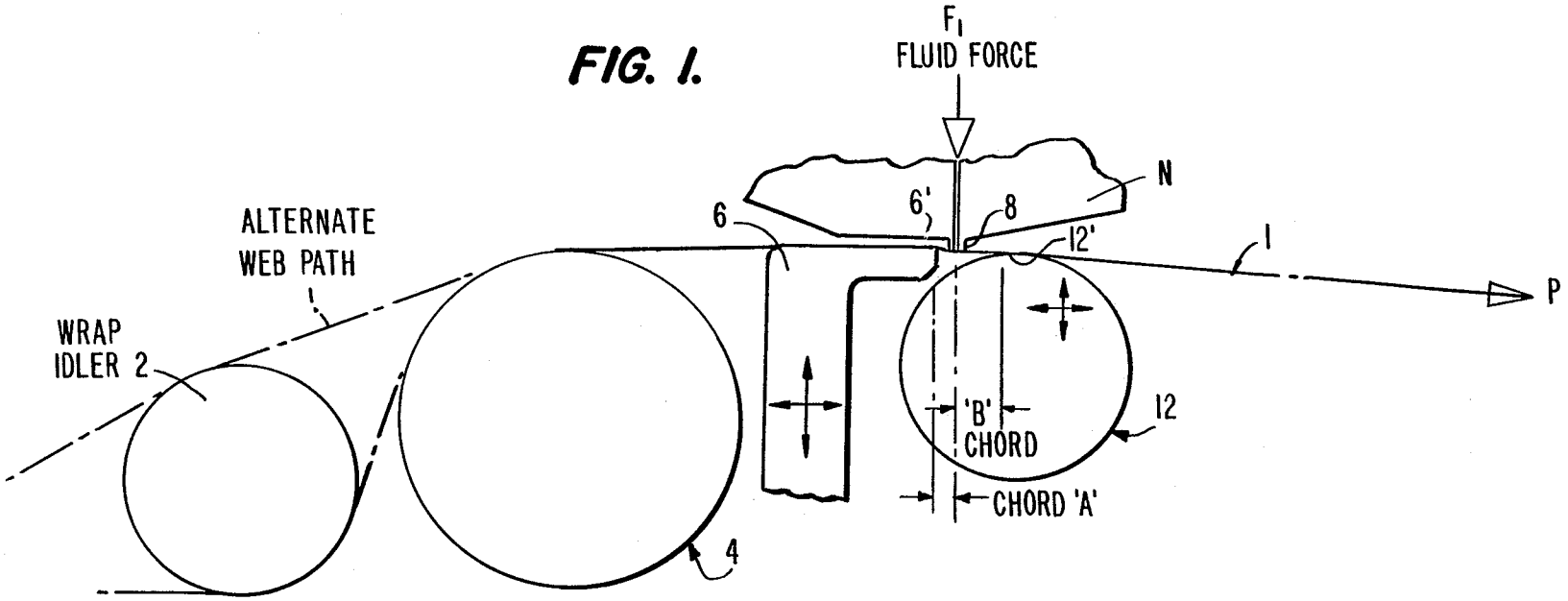
FIG. 1.
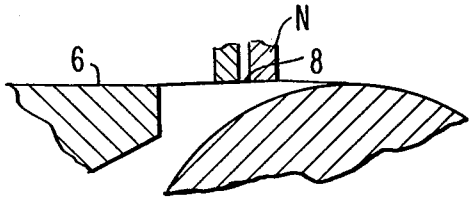
FIG. 2B. "LAYDOWN" TECHNIQUE
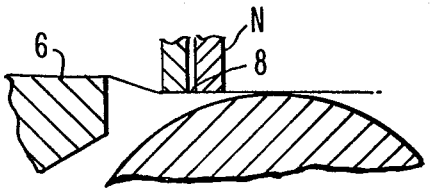
FIG. 2A. "MACHINING TECHNIQUE"

FLUID COATING AND WEB-HANDLING METHOD AND APPARATUS PARTICULARLY ADAPTED FOR LOW-TENSION AND/OR UNEVENLY THICK WEBS

The present invention relates to fluid coating and web handling apparatus and methods such as for applying hot melt adhesives or other coating materials to webs of non-woven or other low web-tension-requiring materials, including those with non-uniform thickness or surface irregularities; but wherein uniform coating weight of intermittent or other fluid coating is desired and irrespective of web line speed variations or surface irregularities.

Such light weight non-wovens are, for example, used in the fabrication of diapers and other products which are formed from webs that cannot be handled under substantial web-drawing tension in view of their susceptibility to transverse deformation and the development of longitudinal creases. While high web tension of the order of 4500 grams per ten-inch web width may be used with label paper stock webs, for example, 50–150 microns thick, without the problems underlying the invention, those problems arise with light weight 100 micron thick non-wovens that cannot tolerate more than about 15 grams per ten inch width web tension. Among the synthetic fiber non-wovens are polyester, polyurethane, acetate and rayon fibers of light weights—for example, of the order of 18 grams per square meter and somewhat above. Such materials, moreover, are not of high thickness dimension tolerances (being, for example, of the order of 100 microns but not of caliper thickness uniformity) and have surface irregularities that make uniform coating weight deposits difficult and particularly irregular, with varying web speeds. The force of coating fluid ejection from application nozzles, such as, for example, the slot nozzle types described in U.S. Letters Patent Nos. 3,595,204 and 4,476,165, moreover, causes substantial transverse deflection of such light weight web materials out of the longitudinal path of travel, causing such problems as uneven coating weight deposits and less than sharp on-set and cut-off of intermittent coating deposits, particularly at higher web speeds, which are not encountered to any disturbing degree with paper and other products.

It is primarily to the solution of these and related problems involved in the coating of web handling of light-weight non-woven and other materials having similar characteristics forbidding normal relatively high-tension web handling or similar susceptibility to deflection from coating application forces and the like, that the present invention is directed; an object of the invention being, accordingly, to provide a new and improved method of and apparatus for coating and handling light weight non-woven and other web materials that obviate the above-described and related problems.

A further object is to provide a novel fluid coating and web handling apparatus of more general utility, as well.

Other and further objects will be explained hereinafter and are more particularly delineated in the appended claims.

In summary, however, from one of its important view points, the invention embraces a method of supporting webs of non-woven and other low-tension web materials, including materials of uneven thickness, drawn along a longitudinal path with relatively low tension past a fluid-coating nozzle to resist deflection of the web laterally of said path upon the intermittent ejection of the fluid from the nozzle upon the web, that comprises, drawing the web as it enters the region of the nozzle over and in supporting contact with an entrance web-supporting surface substantially or almost coplanar with the nozzle fluid-ejecting aperture or slightly above the same and extending to a point just prior to the nozzle aperture; carrying the web beyond said point longitudinally past said nozzle aperture and over an exiting web-support surface; and adjusting the unsupported distances between said point and said nozzle aperture and said nozzle aperture and said exiting websupport surface to minimize the moment of web deflection that otherwise would be caused by the force of fluid ejection application from the nozzle aperture upon the web to compensate for web speed variation and provide substantially the same coating weight of fluid application to the web substantially irrespective of web speed and web thickness variation or irregulaties. Best mode and preferred apparatus details for practicing the invention are hereinafter set forth.

The invention will now be described with reference to the accompanying drawings, FIG. 1 of which is a schematic side elevation illustrating the preferred apparatus for practicing the technique of the invention;

FIGS. 2A and 2B are fragmentary longitudinal sectional views, upon an enlarged scale, of two types of adjustments useful at the nozzle coating region;

Figure 3:
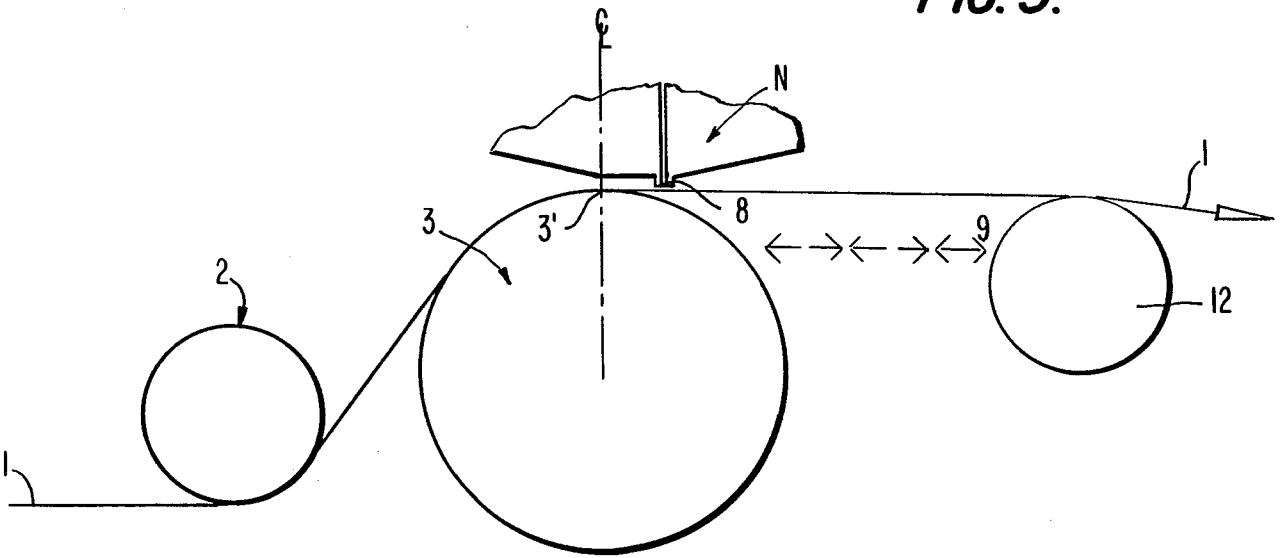
FIG. 3 is a view similar to FIG. 1 of a modification.

Many of the non-wovens and similar materials before discussed are light weight, such as 17 to 28 grams per square meter. As explained, difficulty is experienced in obtaining a well-defined and uniform start and stop intermittent coating at different web speeds. Relatively good intermittent coatings can sometimes be obtained at low speeds, such as 50 feet per minute (FPM) by having the nozzle located just behind top dead center of a back-up roll (that is, on the exiting side of the roll, so that the nozzle aperture or slot is applying fluid to the beginning zone of an unsupported web). At higher web speeds, however, such as 100, 200, and 300 FPM, the intermittent coating becomes progressively less defined, with the result of showing a non-uniform start and stop pattern with ragged leading and trailing edges.

It has now been discovered that by radically departing from conventional nozzle application web-positioning techniques and using relocated positions of the coating nozzle with respect to the proximity of the exiting roller, improved coating integrity up to 300 FPM may be obtained with some light weight materials.

Even though the above intermittent coating patterns were sometimes acceptable up to 300 FPM, however, they deteriorated at higher speeds such as 400 and 500 FPM. It was then discovered that by placing a web-supporting platen close to the entrance position of the coating head it became possible consistently to obtain acceptable intermittent coating patterns with good start and stop definition, at speeds of 400 and 500 FPM and higher.

Referring to FIG. 1, the light-weight non-woven or similar web is shown at 1 longitudinally drawn along path P with relatively low tension, as before explained, (say of the order of 15 grams per ten inch width in the case of an 18 gm/square meter thermal or spin-bonded non-woven material of 100 micron thickness). The web is drawn first under (or over) a wrap idler roll 2 and over an entrance roller 4, and thence over a planar adjustable web-supporting platen surface 6 positioned just prior and close to the aperture 8 of the fluid coater extrusion nozzle N, as of the type described in the above mentioned patents. An exiting web-support surface in the form of the top region 12' of an adjustable cylindrical exit roller 12 is positioned just slightly beyond the nozzle aperture 8, so that the unsupported web distance A (or chord A) between the right hand end point or edge of the entrance web-supporting planar platen surface 6 and the nozzle aperture 8, and the chord B of unsupported distance between the nozzle aperture 8 and the exit web-support region 12' are very small, as of the order of 1/16 inch.

With the entrance support surface 6 substantially coplanar with the nozzle aperture 8, FIG. 2B (or slightly above, FIG. 2A), either a "lay down" surface coating or a "machining" more penetrating coating can be applied to the web at the nozzle head N. In the latter case the web is deflected by the nozzle head as shown.

As the unsupported web distances just prior to (chord A) and just after (chord B) the nozzle aperture 8 are decreased, increasing longitudinal support for the thin web 1 is provided, increasing, in turn, the resistance to or compensation for the moment of deflection downwardly (transverse to the longitudinal web path P) caused by the fluid force $F_1$ of the burst of coating fluid ejected from the nozzle aperture 8 upon the thin web. By adjusting the positions of the entrance and exit web-supporting surfaces 6 and 12' in close relation to the nozzle aperture 8, it has been found that, irrespective of web speed and web thickness variations and surface irregularities of the nature encountered with light weight non-wovens and the like, the tendency for deflection in response to fluid application (particularly intermittent bursts) is admirably compensated for, enabling a uniform coating weight of fluid to be applied with sharp coating cut-ons and cut-offs (leading and trailing coating edges) substantially irrespective of web speed variations.

As shown, the planar platen 6 is quite long compared to the unsupported distance A, and the distances A and B may be comparably short, with the distance B sometimes a bit longer than A.

While the extruded or ejected coating fluid application force increases synchronously as web speed increases, the light web tension is always maintained substantially constant irrespective of web speed. This is necessary since baby diaper non-woven products and the like must not have moderate tension imposed into the final product, as otherwise the shape becomes distorted. With the web tension constant, irrespective of web speed, and the fluid force increasing linearly to web speed, the moment of deflection caused by the fluid force upon the web also increases. To always maintain the same coating weight of fluid application to the web material, irrespective of web speeds, the above compensation for deflection tendency is required and is readily effected by changing the position of the rolls and/or platen with respect to each other; namely moving closer to each other and to the coating nozzle, enabling coating patterns at higher speed that can not be obtained without providing the web support of the invention.

It is not possible, moreover, to take open weave material on non-wovens and coat directly while having a back-up roll located directly under the slot or other nozzle opening. There is the very real possiblity on very light weight and open non-woven materials that the fluid which passes through the openings of the non-woven will contact the back-up roll. It is for this reason, also, as well as the caliper thickness variation of the non-woven materials, that the closely spaced entrance platen and exit roll device of the invention are important.

Figure 3A:
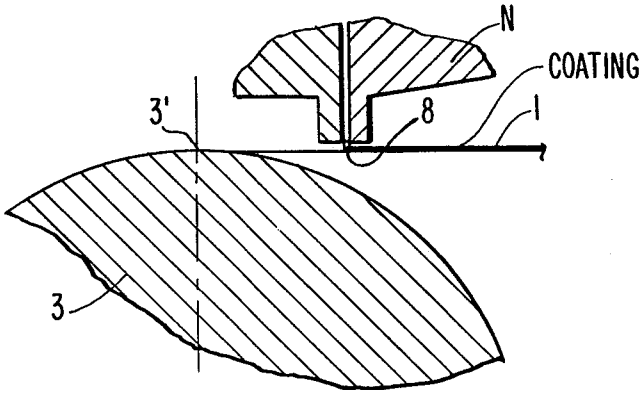
FIG. 3A is a view similar to FIGS. 2A and 2B of the coating region of FIG. 3.

While the planar platen entrance web-support 6 is preferred, there are occasions where a cylindrical roller 3 as in FIG. 3, with its top entrance web-supporting region 3' displaced to the left just prior to the nozzle aperture 8 and substantially coplanar with the nozzle aperture 8, may be employed. Again, variation in the position of the exit roll 12 (shown at 9, with a much greater exiting distance) will determine the extent of unsupported web, degree of compensation for web deflection, and the nature of the coating, FIG. 3A, at varying web speeds.

In systems as shown in FIG. 1, an entrance roll of 3 inches diameter is useful in removing wrinkles and preventing longitudinal creases in the light weight web material; but small diameter rolls may also be used. The roller 12 may also be of an inch or so in diameter, and distances A and B adjusted within limits of about as close to the nozzle head as feasable, say about 1/16 inch unsupported distance A, and a comparable distance B (perhaps somwhat larger). This is suitable for the case of, for example, hot melt fluid as of wax, ethelene vinyl acetate or atactic polypropelene blend or the like, or pressure-sensitive "Krayton" (trademark of Shell) or synthetic rubber, (or the types described in said patents) intermittently applied to diaper-like non-woven material as of 100 micron thick synthetic fibers, with web speeds up to 500 FPM.

Further modifications will occur to those skilled in this art and such are considered to fall within the spirit and scope of the invention as defined in the appended claims.

What is claimed is:

1. A method of supporting webs of non-woven and low-tension web materials, including materials of uneven thickness, drawn along a longitudinal path with relatively low tension past a fluid-coating nozzle at one side of the web to resist deflection of the web laterally of said path upon the intermittent ejection of the fluid from the nozzle upon the web, that comprises, drawing the web as it enters the region of the nozzle over and in supporting contact with an entrance web-supporting surface at the opposite side of the web and substantially or almost coplanar with the nozzle fluid-ejecting aperture and extending to a point just prior to the nozzle aperture; carrying the web beyond said point longitudinally past said nozzle aperture and over an exiting web-support surface at said opposite side of the web, and adjusting the unsupported distances between said point and said nozzle aperture and said nozzle aperture and said exiting web-support surface to minimize the moment of web deflection that otherwise would be caused by the force of fluid ejection application from the nozzle aperture upon the web to compensate for web speed variation and provide substantially the same coating weight of fluid application to the web substantially irrespective of web speed and web thickness variation or irregularities.

2. A method as claimed in claim 1 and in which the web is passed over said supporting surface from an entrance roller and said exiting support surface is provided by an exit roller, with the web tension maintained at a sufficiently low tension to prevent transverse distortion of the web material.

3. A method as claimed in claim 2 and in which the web is drawn over a sufficiently large surface of the entrance roller to obviate longitudinal wrinkles in the web material prior to passage over the supporting surface.

4. A method as claimed in claim 1 and in which the region of support contact of the web with the exiting support surface is substantially coplanar with the web as it passes the nozzle aperture.

5. A method as claimed in claim 1 and in which the entrance supporting surface is planar and of longitudinal length large compared with the said distance between the said point thereof and the nozzle aperture.

6. A method as claimed in claim 6 and in which the exit support surface is a roller surface positioned so that the region of its supporting contact with the exiting web is substantially coplanar with the web as it passes the nozzle aperture.

7. A method as claimed in claim 1 and in which the entrance web supporting surface is cylindrical with the region of supporting contact with the web located at one side of the cylinder and prior to the nozzle aperture.

8. A method as claimed in claim 1 and in which the entrance supporting surface is positioned so as to cause the web to pass in a direction outward of the nozzle in the unsupported distance between said point and the nozzle aperture and then to be deflected by the nozzle as it moves past said nozzle aperture, the region of contact of the web thereafter with the exiting web-support surface being substantially coplanar with the nozzle aperture.

9. A method as claimed in claim 1 and in which the entrance supporting surface, the nozzle aperture and the region of contact of the web with the exiting support surface are substantially coplanar to enable fluid laydown of the coating from the nozzle aperture.

10. Fluid coating and web handling apparatus adapted for non-woven and other low-tension web materials including materials of uneven thickness and that transversely distort and longitudinally crease if drawn with high web tension, said apparatus having, in combination, a coating fluid nozzle applicator provided with an aperture for ejecting fluid upon one side of a web drawn along a longitudinal path past the same, the force of fluid ejection application from the nozzle aperture upon the web being sufficient to produce a substantial moment of web deflection in the absence of web support at the opposite side of the web proximate the nozzle aperture, means for driving the web along said path towards and past the nozzle aperture; and means minimizing the moment of web deflection that would otherwise be caused by the force of fluid ejection application from the nozzle aperture upon the web so as to to compensate for web speed variation and provide substantially the same coating weight of fluid application to the web substantially irrespective of web speed and web thickness variation or irregularities, the last-mentioned means including an entrance web-supporting surface at the opposite side of the web, substantially coplanar with said path, substantially or almost coplanar with said nozzle aperture and extending to a point just prior to the nozzle aperture and over which surface the web is drawn toward said nozzle aperture, an exiting web-support surface at said opposite side of the web and over which the web is drawn after passing the nozzle aperture, and means for adjusting the unsupported distances between said point and said nozzle aperture and said nozzle aperture and said exiting web-support surface.

11. Apparatus as claimed in claim 10 and in which said entrance web-supporting surface, said nozzle aperture and said exit web-supporting surface are substantially coplanar to enable coating lay down as the web passes the nozzle aperture.

12. Apparatus as claimed in claim 10 and in which said enrance web-supporting surface is disposed so as to cause the web to pass in a direction outward of the nozzle aperture in the unsupported distance between said point and the nozzle aperture and to be deflected by the nozzle as the web passes the same.

13. Apparatus as claimed in claim 12 and in which the region of contact of the web with the exiting web-support surface is positioned substantially coplanarly with the nozzle aperture.

14. Apparatus as claimed in claim 10 and in which said entrance web-supporting surface comprises a planar web platen of longitudinal length large compared to the unsupported distance between the said point thereof and the nozzle aperture.

15. Apparatus as claimed in claim 10 and in which said entrance web-supporting surface comprises an entrance roller disposed with its web-supporting surface region a short distance prior to the nozzle aperture.

16. Apparatus as claimed in.claim 10 and in which said exiting web-support surface is a roller having a side region which comprises the web-support surface.

17. Apparatus as claimed in claim 16 and in which the exiting web-support surface roller is disposed just beyond the nozzle aperture to define an unsupported distance from the nozzle aperture comparable to the unsupported distance between said entrance web-supporting surface point and said nozzle aperture.

18. Apparatus as claimed in claim 16 and in which the exiting web-support surface roller is disposed beyond the nozzle aperture to define an unsupported distance from the nozzle aperture that is greater than the unsupported distance between said entrance web-supporting surface point and said nozzle aperture.

19. Apparatus as claimed in claim 10 and in which the said entrance web-supporting surface point is disposed just prior to the nozzle aperture so that the unsupported distance between the same and said nozzle aperture is small.

20. Apparatus as claimed in claim 19 and in which the exiting web-supporting surface point is disposed just after the nozzle aperture so that unsupported distances between the same and said nozzle aperture is small.

* * * * *